US006568783B2

(12) United States Patent
Hu et al.

(10) Patent No.: US 6,568,783 B2
(45) Date of Patent: May 27, 2003

(54) RECOGNITION CIRCUIT FOR AN INK JET PRINTER

(75) Inventors: Hung-Lieh Hu, Hsin-Chu (TW); Chieh-Wen Wang, Hsin-Chu (TW)

(73) Assignee: International United Technology Co., Ltd., Chu-Pei (TW)

( * ) Notice: Subject to any disclaimer, the term of this patent is extended or adjusted under 35 U.S.C. 154(b) by 0 days.

(21) Appl. No.: 10/063,203

(22) Filed: Mar. 28, 2002

(65) Prior Publication Data

US 2003/0030687 A1 Feb. 13, 2003

(30) Foreign Application Priority Data

Aug. 10, 2001 (TW) ..... 90119700 A

(51) Int. Cl.[7] ..... B41J 29/393
(52) U.S. Cl. ..... 347/19; 400/175
(58) Field of Search ..... 347/19; 400/175

(56) References Cited

U.S. PATENT DOCUMENTS 4,930,915 A * 6/1990 Kikuchi et al. ..... 400/175
5,363,134 A * 11/1994 Barbehenn et al. ..... 347/49
5,504,507 A * 4/1996 Watrobski et al. ..... 347/19
5,757,394 A * 5/1998 Gibson et al. ..... 347/19
5,831,649 A * 11/1998 Watrobski et al. ..... 347/19
5,940,095 A * 8/1999 Parish et al. ..... 347/19
6,022,094 A * 2/2000 Gibson et al. ..... 347/19
6,164,758 A * 12/2000 Kretschmer ..... 347/50
6,325,483 B1 * 12/2001 Harbour et al. ..... 347/19
2002/0126170 A1 * 9/2002 Akama et al. ..... 347/19

* cited by examiner

*Primary Examiner*—Craig Hallacher
*Assistant Examiner*—Blaise Mouttet
(74) *Attorney, Agent, or Firm*—Winston Hsu

(57) ABSTRACT

A recognition circuit for an ink jet printer has a plurality of heating cells. Each of the heating cells has a heating element coupled with a power line and a switch coupled with an address line. When voltages are applied to the power line and the address line, the switch is turned on and a current flows via the power line through the heating element. The recognition circuit further has a plurality of identifying cells each coupled with a corresponding power line. The recognition circuit can read the identification code from each the identifying cells by applying voltage to corresponding power lines.

20 Claims, 11 Drawing Sheets

RECOGNITION CIRCUIT FOR AN INK JET PRINTER

BACKGROUND OF INVENTION

1. Field of the Invention

The present invention relates to an ink jet printhead, and more particularly, to a recognition circuit for an ink jet printhead disposed on an ink jet printer.

2. Description of the Prior Art

Please refer to FIG. 1. FIG. 1 is a function block diagram for anormnal identification circuit 45 for an ink jet printer 40 disclosed by a U.S. Pat. No. 5,363,134 named "Integrated circuit print head for an ink jet printer including an integrated identification circuit" by the Hewlett-Packard Company. The identification circuit 45 provides identification information about an ink jet printhead 41 disposed on an ink jet printer 40 to the printer 40. The printer 40 comprises a controller 42 and a printhead drive circuit 43. The controller 42 operates the printer 40. The drive circuit 43 drives the printhead 41. The printer 40 also comprises three busses 47A, 47B, and 47C connecting the controller 42 to the drive circuit 43. The busses 47A, 47B, and 47C transmit the controller's 42 digital control signals to the drive circuit 43, making the drive circuit 43 output corresponding analog voltage impulses to each circuit of the printhead 41. The printhead 41 comprises an array circuit 44, which heats and then sprays ink corresponding to the output signals of the drive circuit 43, an identification circuit 45 that provides printhead identification, information to the ink jet printer 40, and a thermal sensor circuit 46 that provide's the printhead's temperature information to the inkjet printer 40. There are a plurality of row lines 48A (or address lines) and column lines (not shown in FIG. 1) connecting the drive circuit 43 and the array circuit 44. The drive circuit 43 selects and operates each electrical element of the array circuit 44 by these row and column lines.

Please refer to FIG. 2 and FIG. 3. FIG. 2 is a schematic diagram illustrating the array circuit 44. FIG. 3 is a circuit diagram for a resistor cell 39 shown in FIG. 2. The array circuit 44 comprises a plurality of resistor cells 39, disposed on a plurality of rows AN and columns PN, to heat and then spray an ink container"' ink. The plurality of rows (address lines from A0 to A5) and columns (power supply lines from P0 to P5) are connected with the array, circuit 44 to provide to or withhold from each resistor cell 39 the energy to generate heat and then spray the ink. Each resistor cell 39 comprises a resistor 33 and a transistor 34. The transistor 34, coupled with a corresponding address AN, controls current flowing via the resistor 33. When the row and column connected with the resistor cell 39 are applied a positive voltage, the transistor 34 will conduct and generate a current flow through the resistor 33. Then the resistor 33 will heat the ink, generating bubbles to spray the ink droplets.

Please refer to FIG. 4. FIG. 4 is a diagram of the identification circuit 45. The identification circuit 45 comprises a plurality of rows (address lines from A1 to A13) and programmable paths. Each programmable path comprises a fuse (F1 to F13) connected in series to a corresponding transistor"' (Q1 to Q13) gate. Each programmable path provides a one-bit identifying code to the printer 40. The identifying code, either "1" or "0", is determined by the state of each corresponding fuse. Each fuse state provides a different identifying code to the printer 40.

The identification circuit 45 is connected with the address lines. When voltage is applied to one of the address lines, other address lines will be affected, causing abnormal performance of the inkjet printhead 41.

SUMMARY OF INVENTION

It is therefore a primary objective of the claimed invention to provide a recognition circuit for an ink jet printer to solve the above mentioned problem.

According to the claimed invention, the recognition circuit provides the printhead's identification information to the ink jet printer. The recognition circuit includes a plurality of power supply lines, a plurality of address lines, and a control circuit for operating the ink jet printer. The recognition circuit functions by applying a working voltage to the power supply lines, and applying an address voltage to the address lines. The recognition circuit also includes an identification circuit and a heating circuit having a plurality of heating cells. The heating cells connect with a corresponding power supply line and include a heating element and a switch. This switch connects in series to the heating element of the heating cell and a corresponding address line. The control circuit can turn on or turn off the switch via the corresponding address line. When the working voltage is applied to the power supply line coupled with the heating cell and the address voltage is applied to the address line coupled with the switch, the switch is turned on. A current flows from the power supply line through the heating element and the switch, causing the heating element to generate thermal energy.

The identification circuit has a plurality of identifying cells, each of the identifying cells having a first end and a second end. The first end is coupled with both the heating element and the switch of a corresponding heating cell, and the second end is coupled with a common output terminal of the identification circuit. The control circuit can determine whether any individual identifying cell is in a programmed or an un-programmed state by applying an identifying voltage to the power supply line coupled to the corresponding heating cell. The control circuit can therefore generate the identification information of the printhead by determining the states of the identifying cells.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
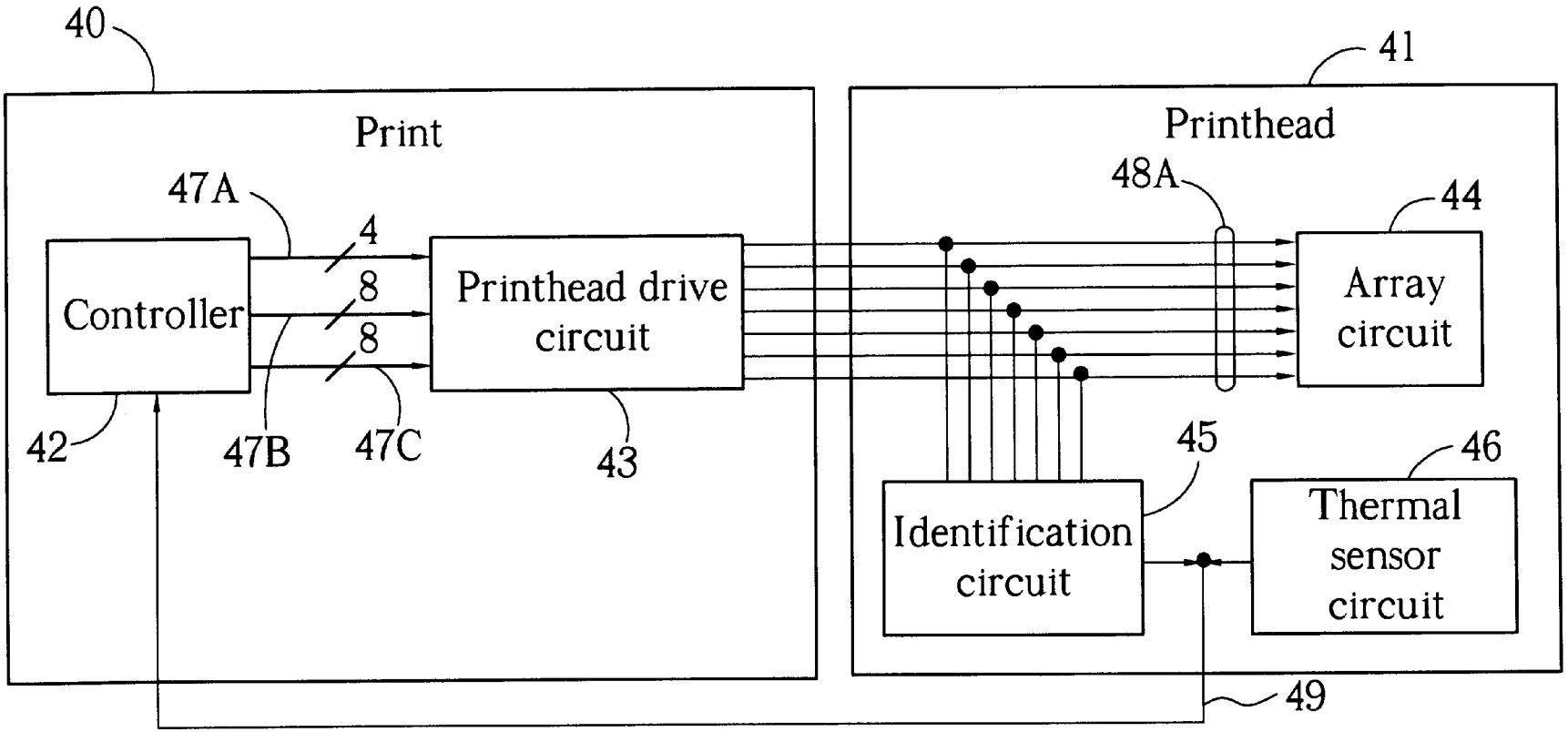
Fig. 1 Prior art
FIG. 1 is a function block diagram of an identification circuit for an ink jet printer according to the prior art.
Figure 2:
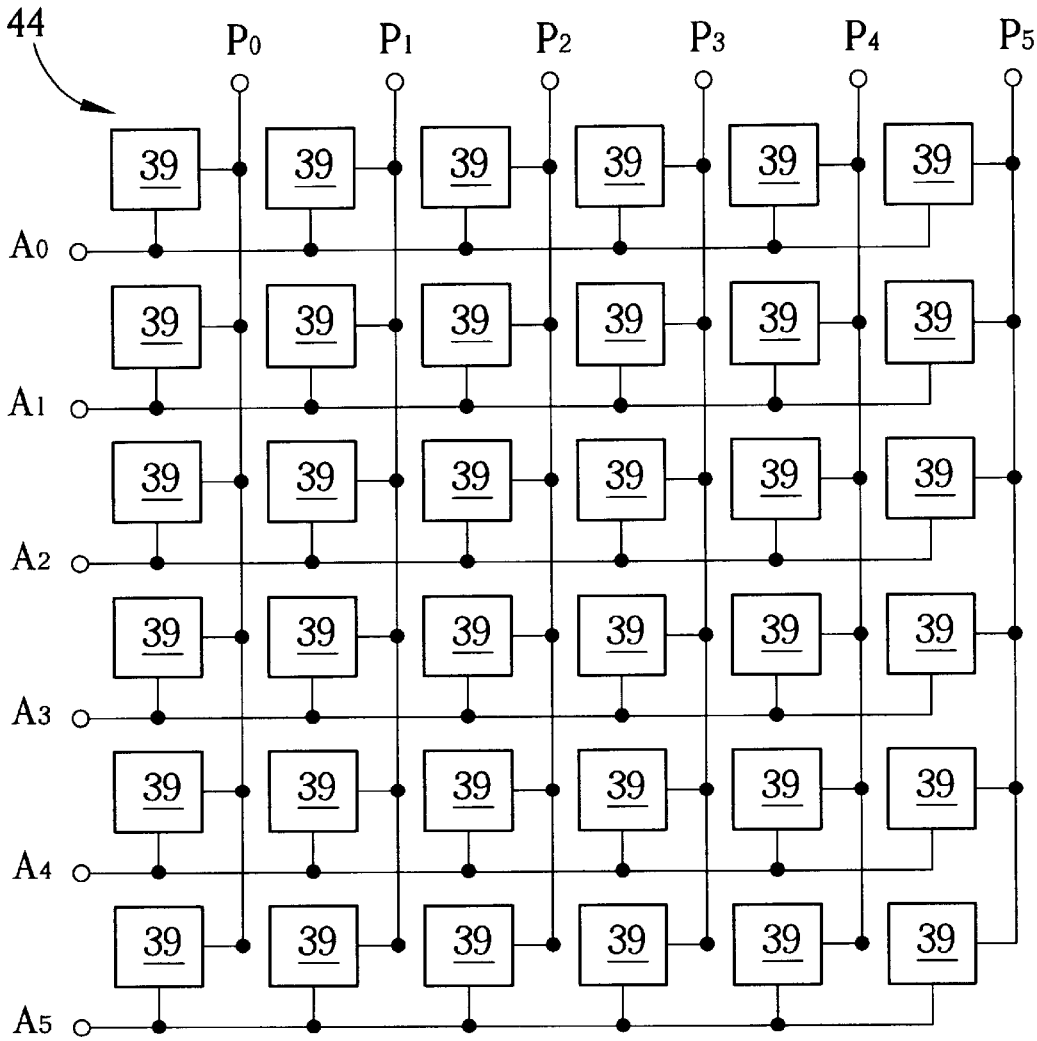
Fig. 2 Prior art
FIG. 2 is a schematic diagram of an array circuit according to the prior art.
Figure 3:
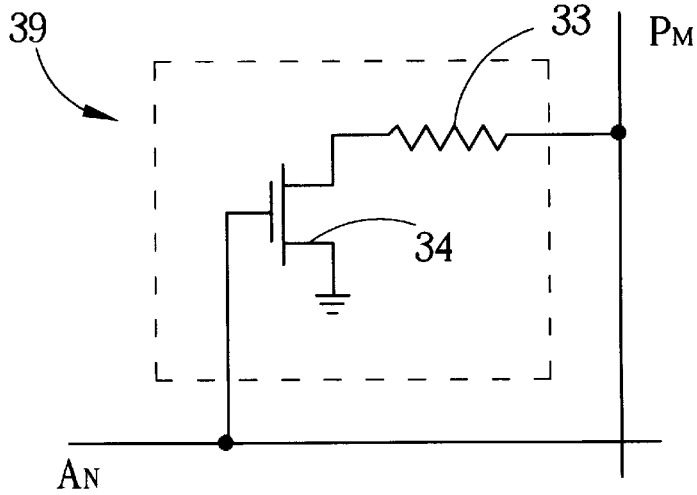
Fig. 3 Prior art
FIG. 3 is a circuit diagram of a resistor cell shown in FIG. 2.
Figure 4:
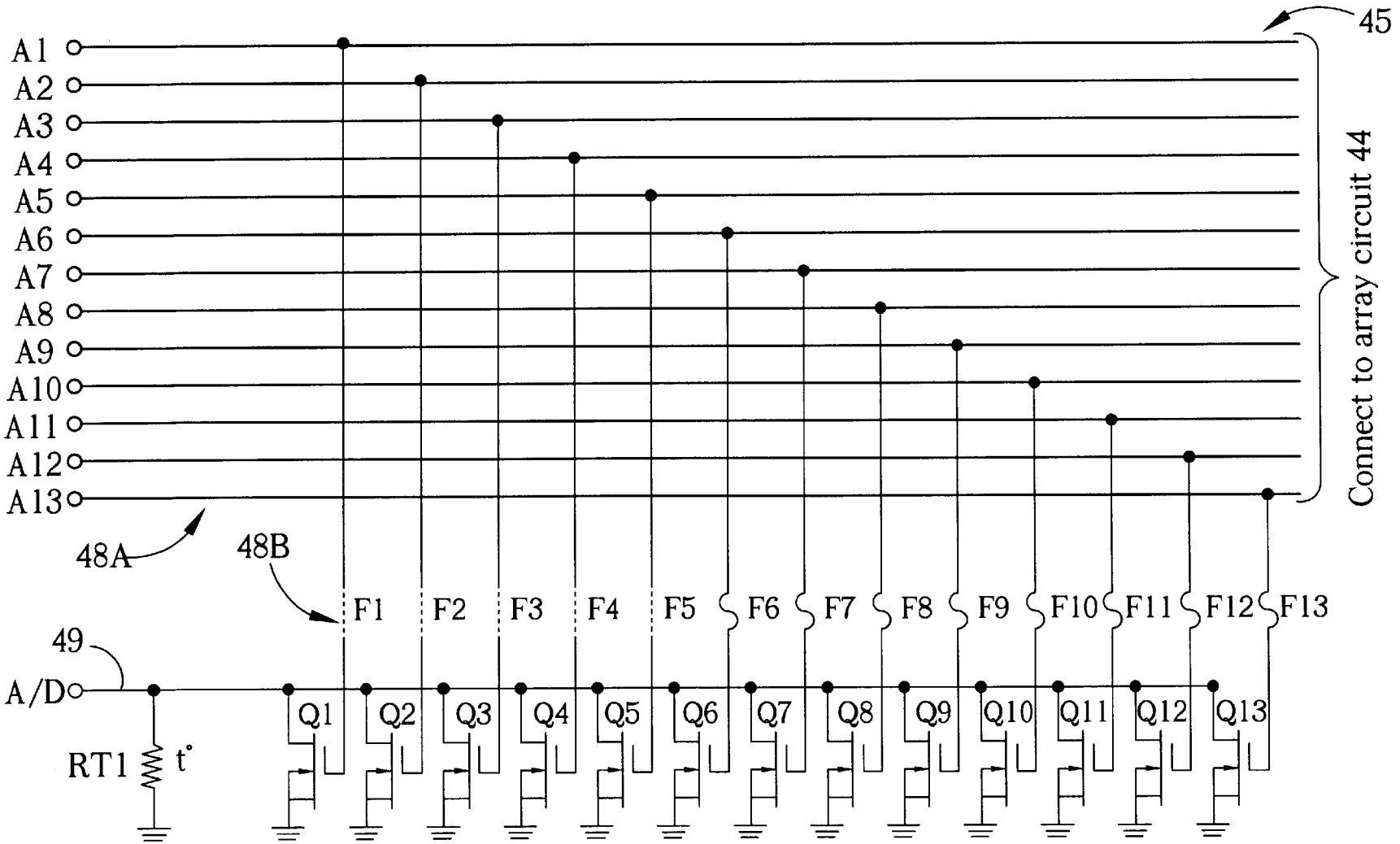
Fig. 4 Prior art
FIG. 4 is a diagram illustrating an identification circuit shown in FIG. 1.
Figure 5:
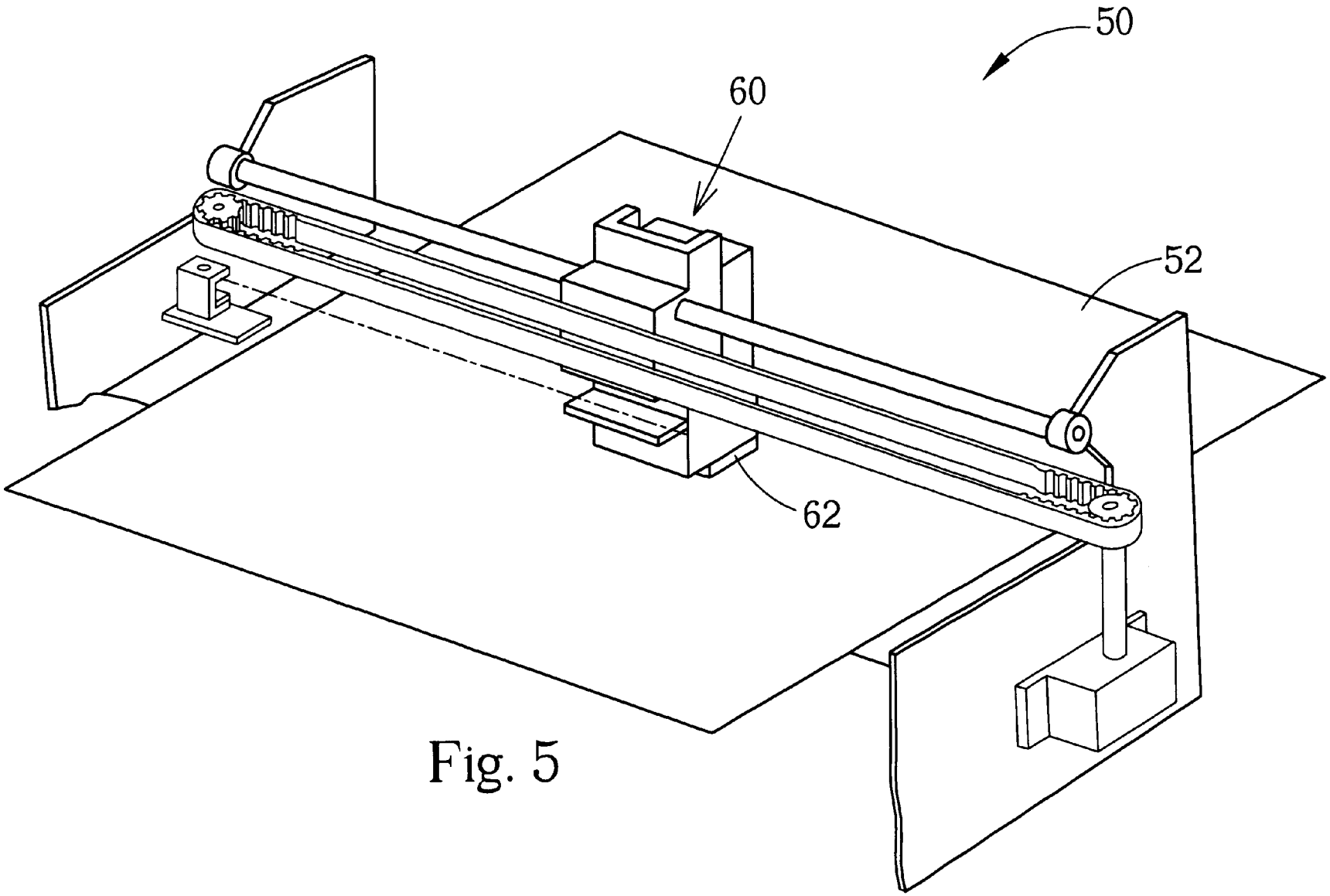
FIG. 5 is a schematic diagram of a recognition circuit for an ink jet printer according to the present invention.
Figure 6:
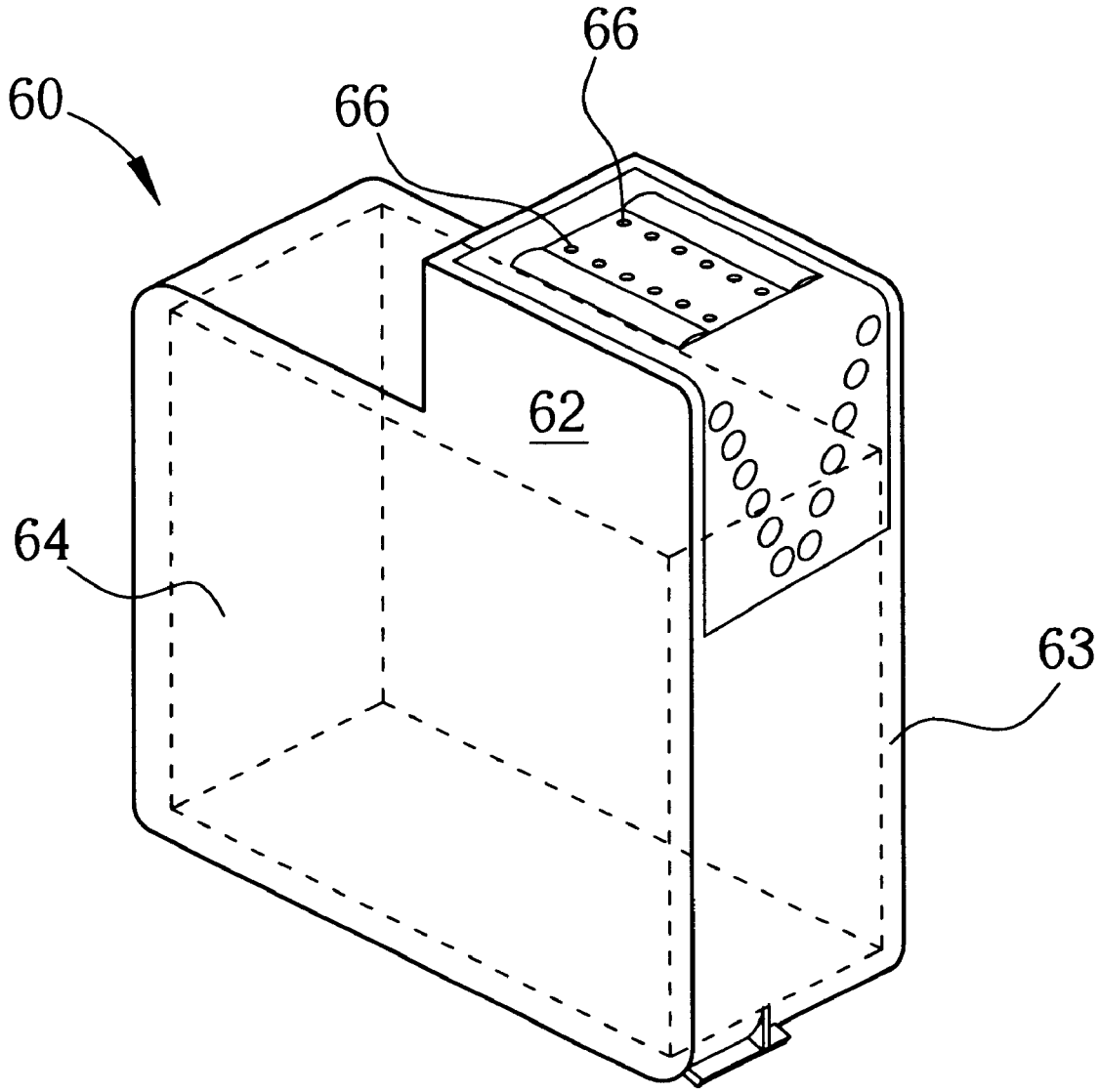
FIG. 6 is a schematic diagram of an ink container shown in FIG. 5.

Please refer to FIG. 5 and FIG. 6. FIG. 5 is a schematic diagram illustrating a recognition circuit for an ink jet printer 50 according to the present invention. FIG. 6 is a schematic diagram of an ink container 60. The ink container 60, installed in the printer 50, comprises an ink jet printhead 62 and a case 63. An ink storage tank 64 is installed in the case 63 and is connected with the printhead 62. The printhead 62 sprays ink on a printing media 52 forming an image. The printhead 62 comprises a plurality of nozzles 66. Ink in the ink storage tank 64 can be sprayed from the nozzles 66 after the ink has been heated.

Figure 7:
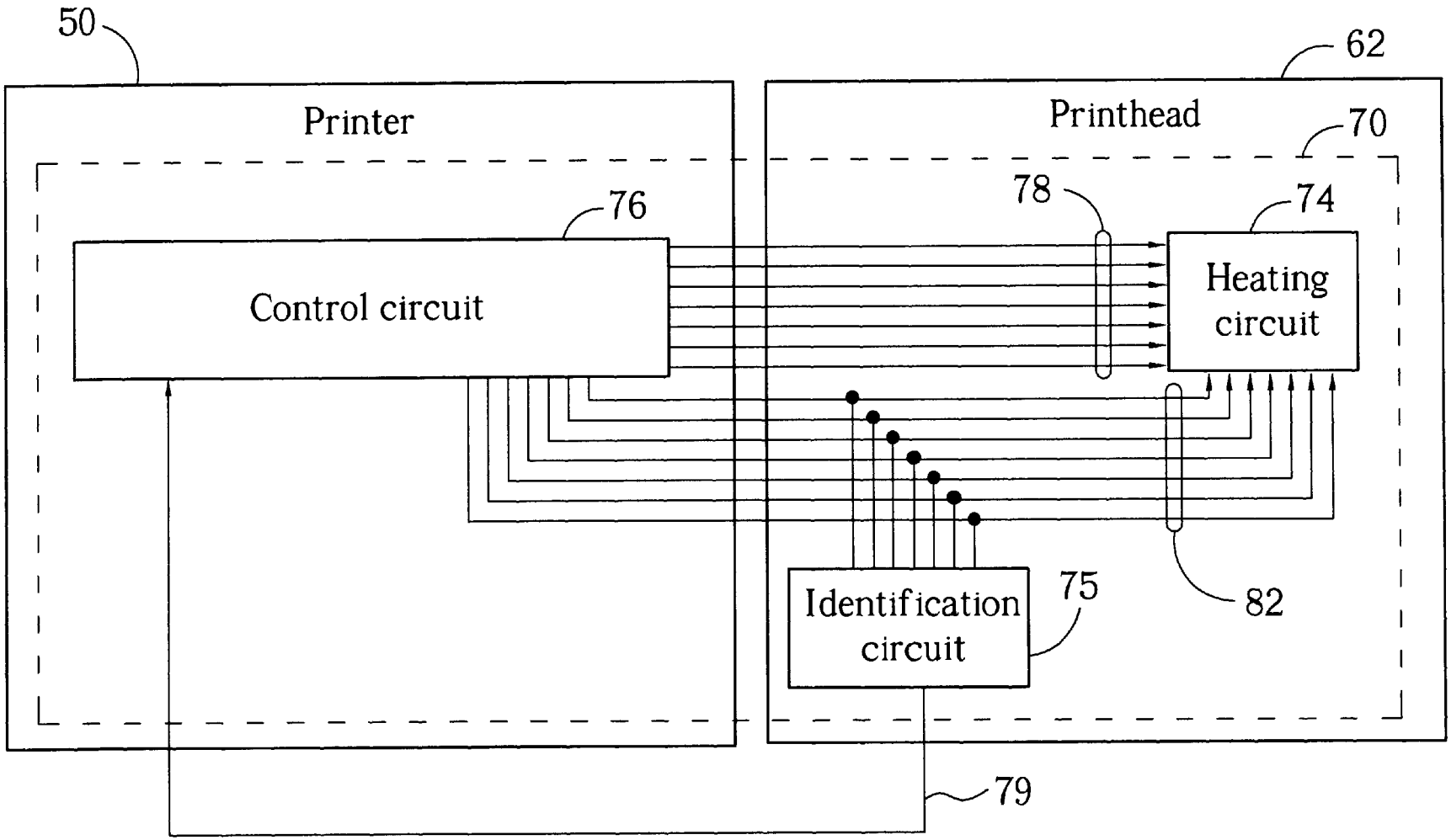
FIG. 7 is a function block diagram of a printer shown in FIG. 5.

Please refer to FIG. 7. FIG. 7 is a function block diagram of the printer 50 shown in FIG. 5. The printer 50 comprises a control circuit 76 for operating the printer 50. The printhead 62 comprises a heating circuit 74, a plurality of address lines 78, a plurality of power supply lines 82, and an identification circuit 75 for connecting with the power supply lines 82. The heating circuit 74 applies heat to the storage tank's 64 ink and then sprays the ink through the nozzles 66 depending on an output signal of the control circuit 76.

According to the present invention, a recognition circuit 70 provides the printhead's 62 identification information to the ink jet printer 50. The recognition circuit 70 comprises the control circuit 76 of the printer 50, the heating circuit 74 of the printhead 62, the identification circuit 75 of the printhead 62, the plurality of address lines 78, and the plurality of power supply lines 82. The recognition circuit's 70 operations will be further described in the following paragraphs. It, should be particularly pointed out that the identification information from printhead 62 provides only the ink container model number, the number of nozzles, the kind of ink, and so on, but the recognition circuit 70 can provide more.

Figure 8:
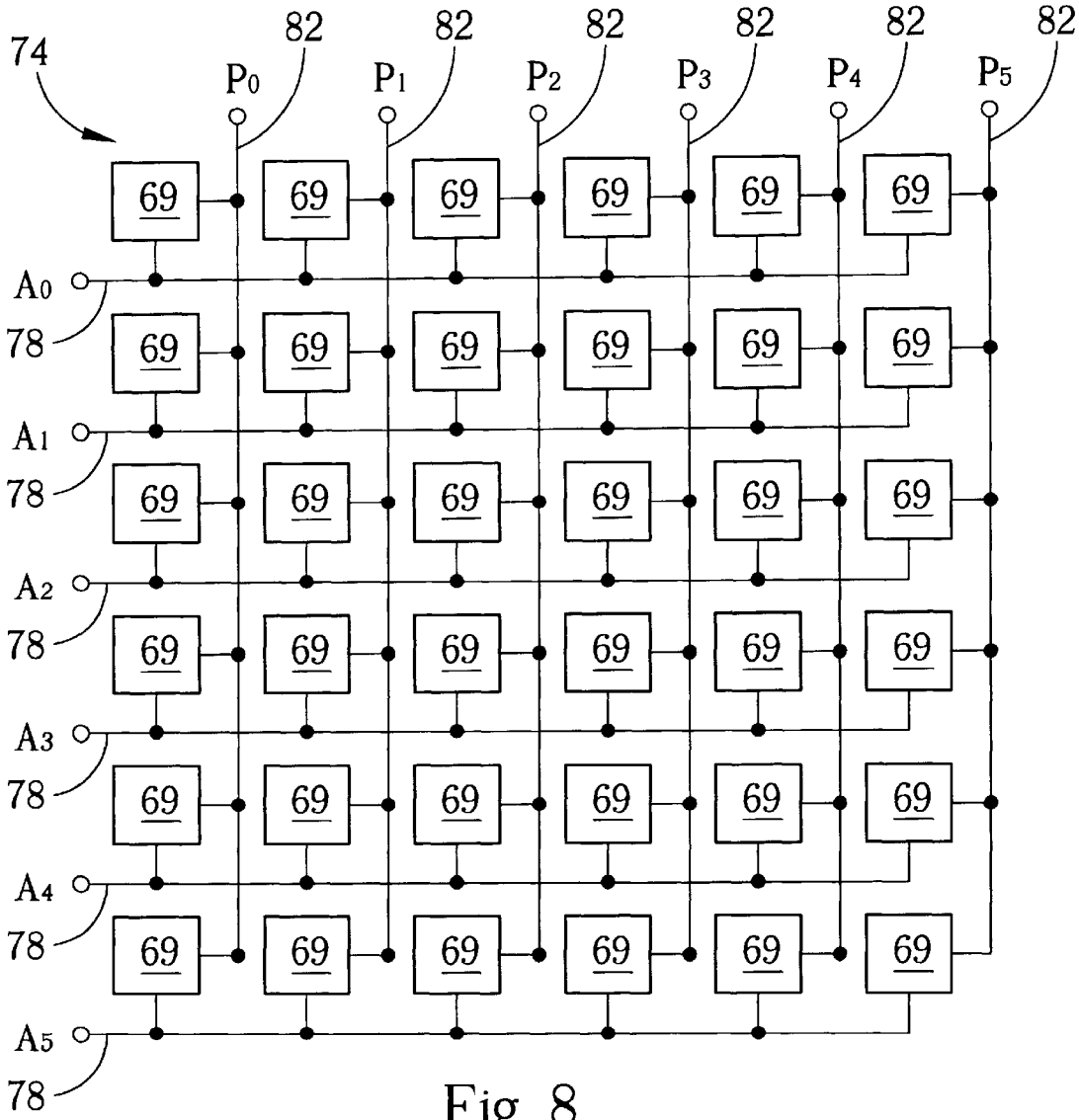
FIG. 8 is a schematic diagram of a heating circuit shown in FIG. 7.
Figure 9:
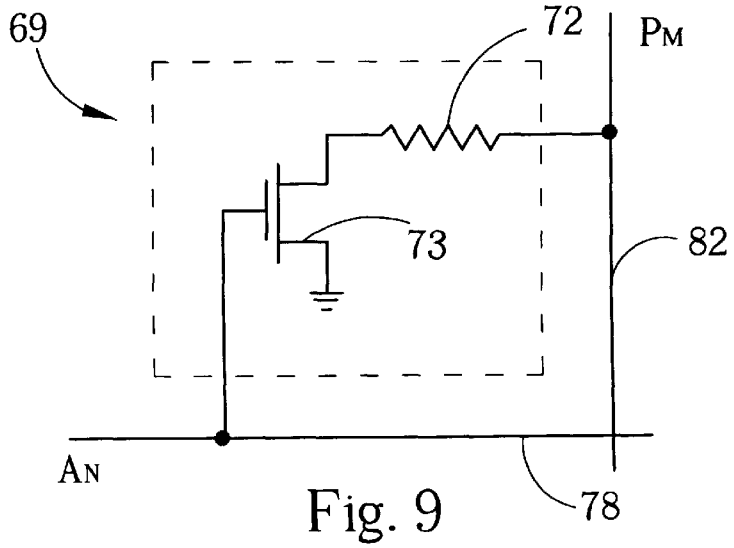
FIG. 9 illustrates a heating cell shown in FIG. 8.
Figure 10:
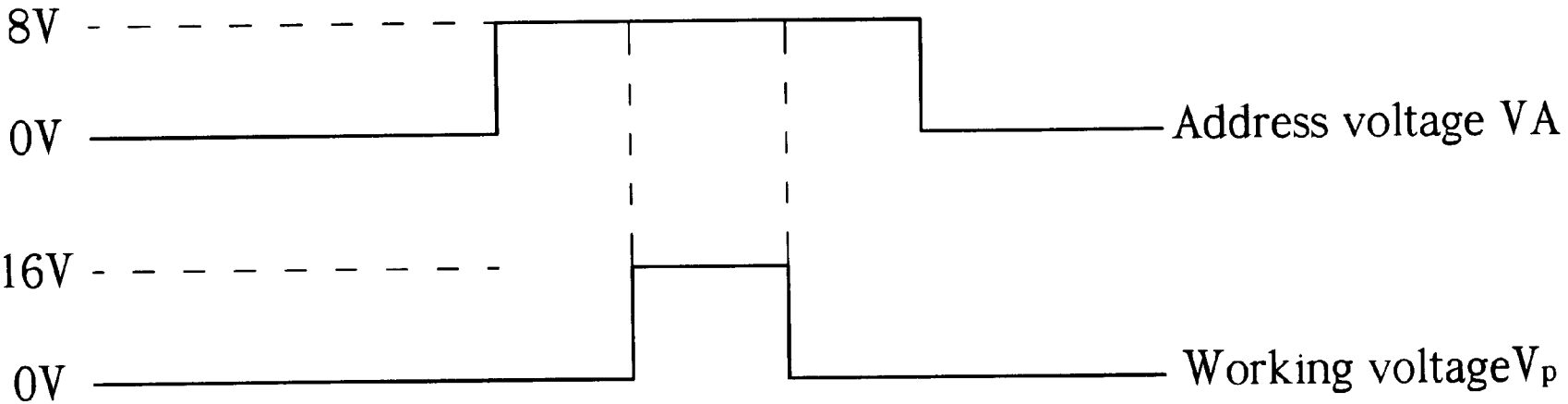
FIG. 10 is a timing diagram of two signals from a printer shown in FIG. 5.

Please refer to FIG. 8, FIG. 9, and FIG. 10. FIG. 8 is a schematic diagram illustrating the heating circuit 74 shown FIG. 7. FIG. 9 is a circuit diagram of a heating cell 69 shown in FIG. 8. FIG. 10 is a timing diagram illustrating each signal of the printer 50 shown in FIG. 5. The heating circuit 74 comprises a plurality of heating cells 69 coupled with a corresponding power supply line 82. Each heating cell 69 comprises a heating element 72 and a switch 73. The switch 73 is connected in series to the heating element 72 and a corresponding address line 78. The heating element 72 is a resistor and heats the ink when any current flows through the heating element 72. The switch 73 is a MOS transistor, which comprises a drain, a source, and a gate coupled with the corresponding address line. 78. The switch 73 will change from a "non-conductive" state to a "conductive" state when a positive voltage is applied to the address line 78. Therefore, the printer's 50 control circuit 76 will turn on or off each heating cell's 69 switch 73 with the corresponding address line 78. When the power supply line 82 is applied a working voltage VP and the address line is applied a control voltage VA, the switch 73 will turn on, generating a current flow via the power supply line 82, the heating element 72, and switch 73, making the heating element 72 generate heat. Each heating cell corresponds to a single nozzle 66. Ink is sprayed from the corresponding nozzle 66 when the heating cell's 69 heating element 72 generates heat.

Figure 11:
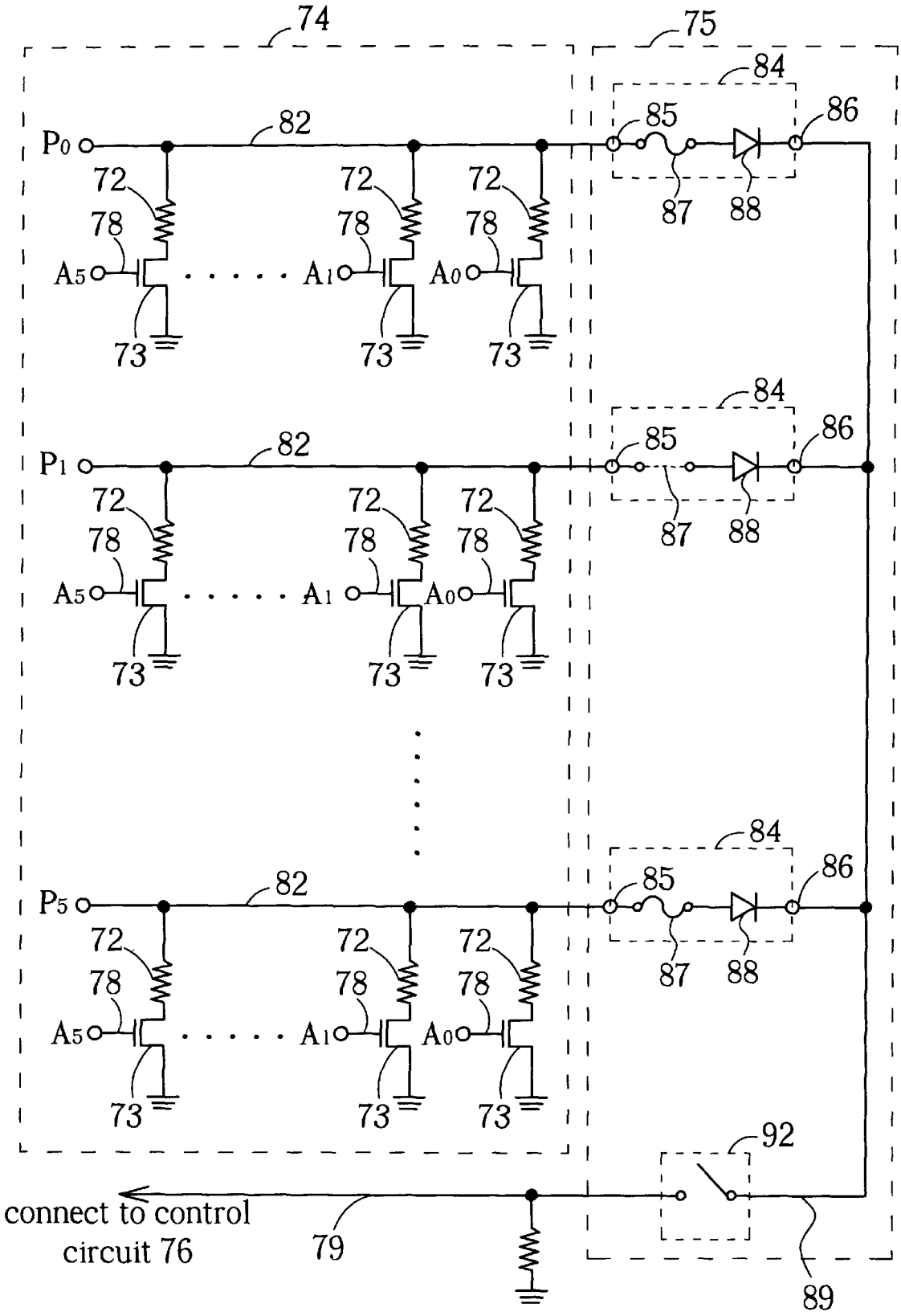
FIG. 11 illustrates an identification circuit and a heating circuit shown in FIG. 7.

Please refer to FIG. 11. FIG. 11 is a diagram Illustrating the identification circuit 75 and the heating circuit 74 shown in FIG. 7. The identification circuit 75, coupled with the control circuit 76 via a signal transmission line 79, transmits identification information to the control circuit 76. The identification circuit 75 comprises a plurality of identifying cells 84, each comprising a fuse 87 and an electrical element 88 connected in series. Each identifying cell 84 provides a one-bit identification code to the printer 50. The identification code, either "1" or "0", is determined the state of each corresponding fuse. That is to say, a different fuse state combination provides different identification information to the printer 50. The electrical element 88 is a diode to control current flow direction in the identifying cell 84. When one of the power supply lines 82 is applied a voltage, the other power supply lines will not be affected because of the diode's 88 rectification function. This guarantees that the heating circuit 74 functions normally when heating ink. The identification circuit 75 comprises a switch circuit 92 for establishing and abolishing an electrical connection between identification circuit 75 and the control circuit 76. Before the printer 50 receives identification information from the identification circuit 75, the control circuit 76 will turn on the switch circuit 92. After the printer 50 receives identification information from the identification circuit 75, the control circuit 76 will turn off the switch circuit 92. Additionally, the switch circuit 92 remains turned off when the heating circuit 74 heats ink. Therefore, the identification circuit 75 cannot transmit identification information to the control circuit 76 via the signal transmission line 79 when the control circuit 76 applies a working voltage VP to the power supply line 82.

Each identifying cell 84 has a first end 85 coupled with the corresponding power supply line 82 and a second end 86 coupled with a common output end 89 of the identification circuit 75. The common output end 89 establishes or abolishes electrical connections via the signal transmission line 79 with the control circuit 76 using the switch circuit 92. When manufacturing the ink container 60, all the fuses 87 of the identification circuit 75 pass through a procedure, setting some of the fuses 87 as "programmed", or non-conductive, and the remaining fuses 87 as "un-programmed", or conductive. Where the fuses 87 are programmed, an open circuit exists between the first end 85 and the second end 86 of the identifying cells 84, for example, the identifying cell 84 connected to the power supply line P1. A un-programmed fuse 87 means that a closed circuit exists between the first end 85 and the second end 86 of the identifying cells 84, for example, the identifying cell 84 connected to the power supply line P0. The printer's 50 control circuit 76 can identify whether each identifying cell 84 is in a programmed or un-programmed state by applying an identifying voltage to the corresponding power supply line 82. Each of the identifying cells 84 that contain a programmed fuse 87 has an open circuit between the first end 85 and the second end 86.Each of the identifying cells 84 that contain a un-programmed fuse 87 has a closed circuit between the first end 85 and the second end 86. The common output end's voltage 89 will not change when the control circuit 76 applies an identifying voltage to the power supply line 82 connected with programmed identifying cells 84. Whereas the common output end's voltage 89 will increase when the control circuit 76 applies an identifying voltage to the power supply line 82 connected with un-programmed identifying cells 84. Therefore, the control circuit 76 can read each identifying cell's 84 code as "1" or "0" by applying an identifying voltage to the power supply line 82 connected with the corresponding identifying cell 84. By combining the identifying cell's codes, the control circuit 76 can generate the printhead's 62 identification information.

Figure 12:
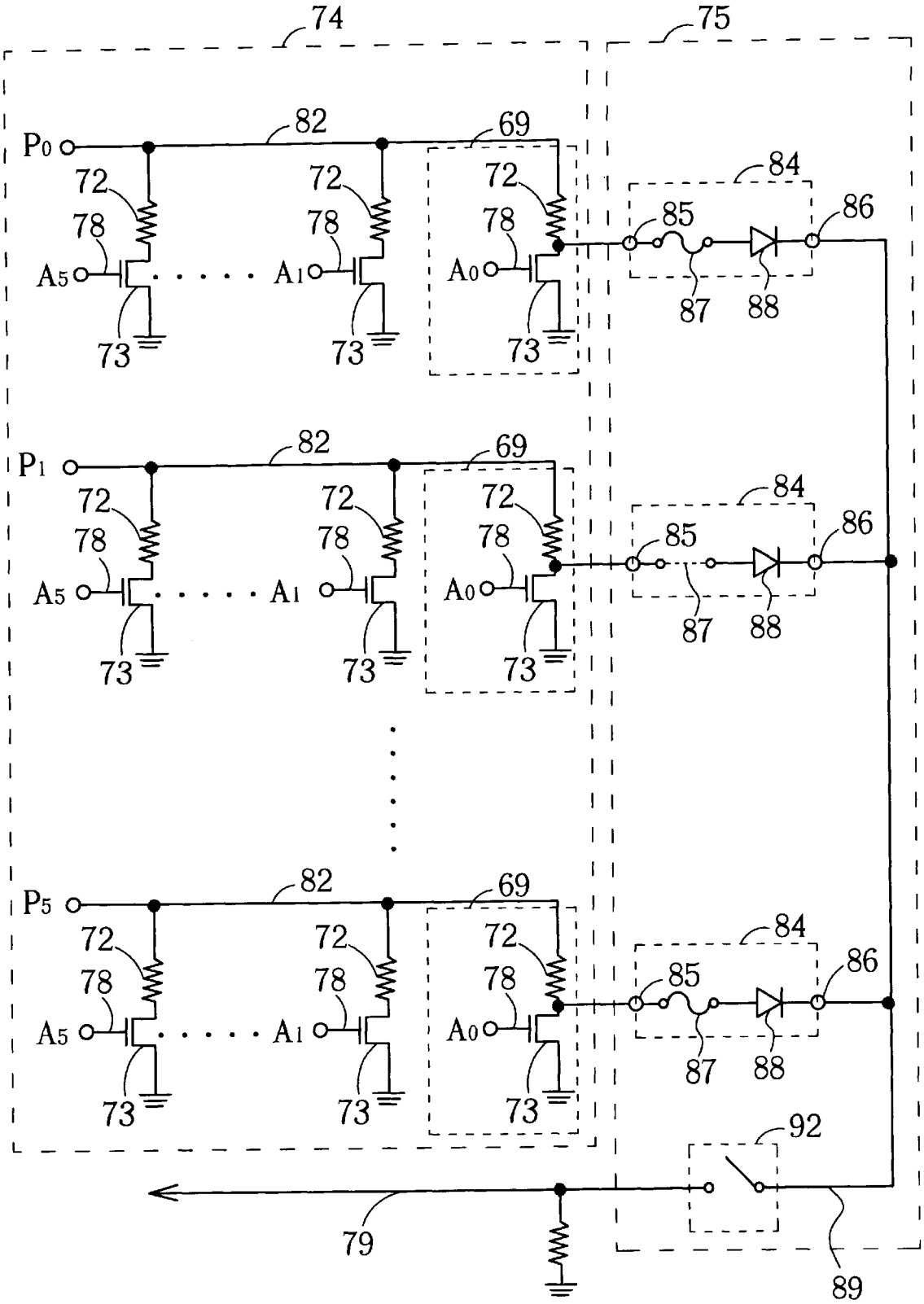
FIG. 12 illustrates another identification circuit and another heating circuit shown in FIG. 7.

Please refer to FIG. 12. FIG. 12 is a diagram illustrating another identification circuit 75 and heating circuit 74 shown in FIG. 7. An obvious difference in this embodiment is that each identifying cell's 84 first end 85 of identification circuit 75 connects with the switch 73 and the heating element 72 of each corresponding heating cell 69. The control circuit 76 can read each identifying cell's 84 code as "1" or "0" by applying an identifying voltage to the power supply line 82 connected with each corresponding identifying cell 84. Control circuit 76 can also generate a printhead's 62 identification information by combining the identifying cell's codes. It needs to be emphasized that if the switch circuit 92 is open and the control circuit 76 applies an identifying voltage to the power supply line 82 but the corresponding fuse 87 is un-programmed, a current will flow through heating element 72 and heating the ink. However, because the identifying voltage is much smaller than the working voltage VP (generally working voltage VP is 16 volts but identifying voltage is only below 5 volts), the heat generated by the identifying voltage is not hot enough to boil and spray the ink from the nozzles 66.

Figure 13:
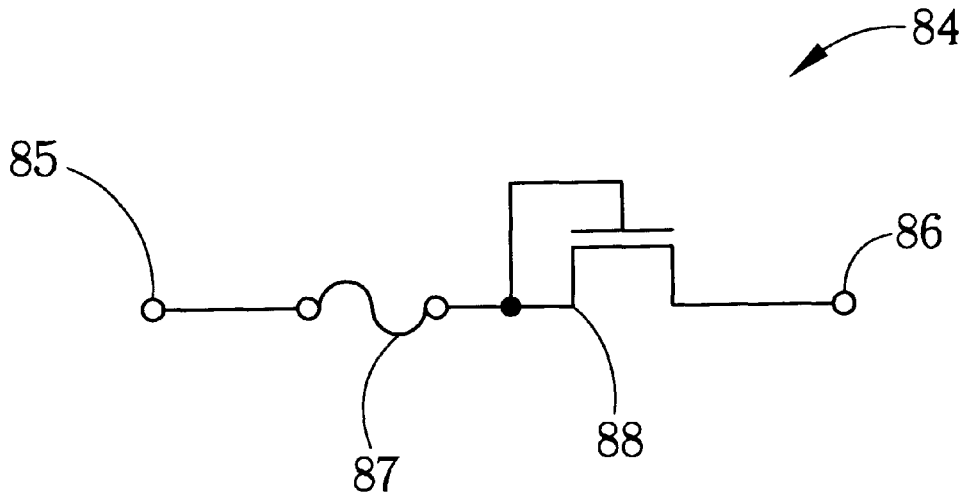
FIG. 13 illustrates another identifying cell circuit shown in FIG. 11.

Please refer to FIG. 13. FIG. 13 is a diagram of another identifying cell circuit 84 shown in FIG. 11. The electrical element 88, can be either a diode, as mentioned before, or a MOS diode. This MOS diode, whose gate is coupled with the fuse 87, controls the identifying cell's 84 current-flow, direction.

Figure 14:
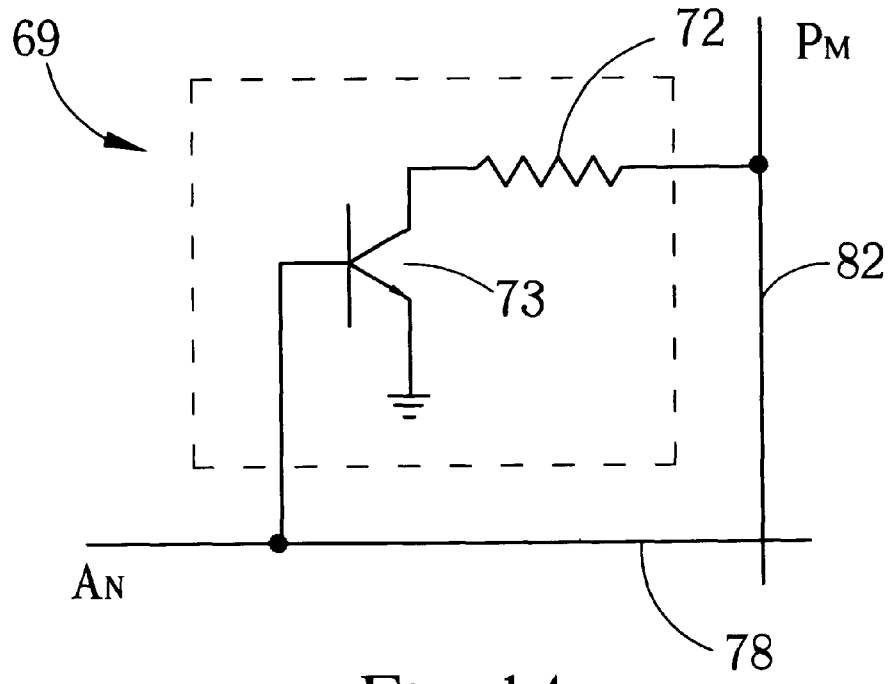
FIG. 14 illustrates another heating cell circuit shown in FIG. 8.

Please refer to FIG. 14. FIG. 14 is a diagram illustrating another heating cell 69 circuit shown in FIG. 8. The switch 73 of the heating cell 69 can be either a MOS diode, as mentioned above, or a BJT. This BJT comprises an emitter, a gate, and a base coupled with a corresponding address line 78.

In contrast to the prior art, the recognition circuit for this invention is connected with power supply lines, rather than address lines. This recognition circuit has a plurality of identifying cells. Each of the identifying cells has a fuse and an electrical element. This element can control the current-flow direction in an identifying cell. When voltage is applied to one of power supply lines, the others will not be affected because of a rectification function by that electrical element. This will guarantee that the heating circuit of the printhead can function normally while heating ink.

Following the detailed description of the present invention above, those skilled in the art will readily observe that numerous modifications and alterations of the device may be made while retaining the teachings of the invention. Accordingly, the above disclosure should be construed as limited only by the metes and bounds of the appended claims.

What is claimed is:

1. A recognition circuit for providing identification information of an ink jet printhead to a ink jet printer, the ink jet printhead being disposed in the ink jet printer, the recognition circuit comprising:

a plurality of power supply lines;

a plurality of address lines;

a control circuit for controlling operations of the ink jet printer, applying a working voltage to the plurality of the power supply lines, and applying an address voltage to the plurality of the address lines;

a heating circuit having a plurality of heating cells, each of the heating cells being coupled with a corresponding power supply line and comprising:

a heating element; and a switch connected in series to the heating element of the heating cell and coupled with a corresponding address line, wherein the control circuit is capable of turning on and turning off the switch via the corresponding address line, and when the working voltage is applied to the power supply line coupled with the heating cell and the address voltage is applied to the address line coupled with the switch, the switch is turned on so that a current flowing through the power supply line, the heating element, and the switch is generated and the heating element generates thermal energy; and an identification circuit having a plurality of identifying cells, each of the identifying cells having a first end and a second end, wherein the first end is coupled with both the heating element and the switch of a corresponding heating cell, and the second end is coupled with a common output terminal of the identification circuit, and the control circuit is capable of determining whether the identifying cell is in a programmed state or in an un-programmed state by applying a recognizing voltage to the power supply line coupled with the corresponding heating cell;

wherein the control circuit is capable of generating the identification information of the ink jet printhead by determining the states of the identifying cells.

2. The recognition circuit of claim 1 wherein each of the identifying cells in the programmed state is an open circuit, and each of the identifying cells in the un-programmed state has a current path between its first end and its second end.

3. The recognition circuit of claim 1 wherein the ink jet printer comprises a ink container for storing ink, the printhead comprises a plurality of nozzles and is able to exchange fluid with the ink container, each of the nozzles corresponds to one of the heating elements, and when the corresponding heating element generates thermal energy, the nozzle ejects the ink.

4. The recognition circuit of claim 1 wherein each of the identifying cells comprises a fuse and an electronic element connected in series to the fuse for restricting any current from flowing from the second end to the first end of the identifying cell.

5. The recognition circuit of claim 4 wherein the electronic element is a diode.

6. The recognition circuit of claim 4 wherein the electronic element is a metal-oxide semiconductor (MOS) transistor and comprises a drain, a gate coupled with the fuse, and a source.

7. The recognition circuit of claim 1 further comprising a switch circuit for establishing and abolishing electrical connection between the identification circuit and the control circuit.

8. The recognition circuit of claim 1 wherein each of the heating elements is a resistor.

9. The recognition circuit of claim 1 wherein each of the switches is a bipolar junction transistor (BJT) and comprises an emitter, a base coupled with the corresponding address line, and a collector.

10. The recognition circuit of claim 1 wherein each of the switches is a MOS transistor and comprises a drain, a gate coupled with the corresponding address line, and a source.

11. A recognition circuit for providing identification information of an ink jet printhead to a ink jet printer, the ink jet printhead being disposed in the ink jet printer, the recognition circuit comprising:

a plurality of power supply lines;

a plurality of address lines;

a control circuit for controlling operations of the ink jet printer, applying a working voltage to the plurality of the power supply lines, and applying an address voltage to the plurality of the address lines;

a heating circuit having a plurality of heating cells, each of the heating cells being coupled with a corresponding power supply line and comprising:

a heating element; and a switch coupled with a corresponding address line, wherein the control circuit is capable of turning on and turning off the switch via the corresponding address line, and when the working voltage is applied to the power supply line coupled with the heating cell and the address voltage is applied to the address line coupled with the switch, the switch is turned on so that a current flowing through the power supply line, the heating element, and the switch is generated and the heating element generates thermal energy; and an identification circuit having a plurality of identifying cells, each of the identifying cells having a first end and a second end, wherein the first end is coupled with the heating element of a corresponding heating cell, and the second end is coupled with a common output terminal of the identification circuit, and the control circuit is capable of determining whether the identifying cell is in a programmed state or in an un-programmed state by applying a recognizing voltage to the power supply line coupled with the corresponding heating cell;

wherein the control circuit is capable of generating the identification, information of the ink jet printhead by determining the states of the identifying cells.

12. The recognition circuit of claim 11 wherein each of the identifying cells in the programmed state is an open circuit, and each of the identifying cells in the un-programmed state has a current path between its first end and its second end.

13. The recognition circuit of claim 11 wherein the ink jet printer comprises a ink container for storing ink, the printhead comprises a plurality of nozzles and is able to exchange fluid with the ink container, each of the nozzles corresponds to one of the heating elements, and when the corresponding heating element generate's thermal energy, the nozzle ejects the ink.

14. The recognition circuit of claim 11 wherein each of the identifying cells comprises a fuse and an electronic element connected in series to the fuse for restricting any current from flowing from the second end to the first end of the identifying cell.

15. The recognition circuit of claim 14 wherein the electronic element is a diode.

16. The recognition circuit of claim 14 wherein the electronic element is a metal-oxide semiconductor (MOS) transistor and comprises a drain, a gate coupled with the fuse, and a source.

17. The recognition circuit of claim 11 further comprising a switch circuit for establishing and abolishing electrical connection between the identification circuit and the control circuit.

18. The recognition circuit of claim 11 wherein each of the heating elements is a resistor.

19. The recognition circuit of claim 11 wherein each of the switches is a bipolar junction transistor (BJT) and comprises an emitter, a base coupled with the corresponding address line, and a collector.

20. The recognition circuit of claim 11 wherein each of the switches is a MOS transistor and comprises a drain, a gate coupled with the corresponding address line, and a source.

* * * * *